US005464355A

United States Patent [19]

Rothenberger

[11] Patent Number: 5,464,355

[45] Date of Patent: Nov. 7, 1995

[54] SEALED LAND GRID ARRAY CONNECTOR

[76] Inventor: Richard E. Rothenberger, 5 State Dr., Harrisburg, Pa. 17112

[21] Appl. No.: 183,556

[22] Filed: Jan. 19, 1994

[51] Int. Cl.[6] ..... H01R 13/73

[52] U.S. Cl. ..... 439/559; 439/564; 439/78

[58] Field of Search ..... 439/559, 583, 439/271, 276, 736, 278, 78, 564

[56] References Cited

U.S. PATENT DOCUMENTS

| | | | |
|---|---|---|---|
| 3,022,484 | 2/1962 | Thompson, Jr. . | |
| 4,030,799 | 6/1977 | Venaleck | 339/99 R |
| 4,447,103 | 5/1984 | Werth et al. | 339/94 M |
| 4,484,021 | 11/1984 | Schaefer et al. | 174/53 |
| 4,639,063 | 1/1987 | Mueller | 339/75 M |
| 4,655,519 | 4/1987 | Evans et al. | 339/17 CF |
| 4,676,575 | 6/1987 | Denlinger et al. | 439/271 |
| 4,718,859 | 1/1988 | Gardner | 439/329 |
| 4,775,333 | 10/1988 | Grider et al. | 439/736 |
| 4,891,019 | 1/1990 | Olsson | 439/404 |
| 4,898,539 | 2/1990 | Glover et al. | 439/81 |
| 4,960,391 | 10/1990 | Beinhaur et al. | 439/559 |
| 4,976,634 | 12/1990 | Green et al. | 439/589 |
| 4,978,315 | 12/1990 | Edgley et al. | 439/441 |
| 4,981,432 | 1/1991 | Kikuchi | 439/417 |
| 5,176,541 | 1/1993 | Mori | 439/736 |
| 5,284,448 | 2/1994 | Hussmann et al. | 439/559 X |

*Primary Examiner*—David Pirlot

*Attorney, Agent, or Firm*—June B. Schuette; Timothy J. Aberle

[57] ABSTRACT

An electrical connector for sealably mounting into a frame may be manufactured using known low cost, automated processes. Contact elements are sealingly encircled by and extend through an insulating body having a frame abutting surface. A separate shroud interfits with the body at an unsealed shroud junction. A continuous compressible sealing element disposed on a frame abutting surface circumscribes and sealingly isolates an area interior of the compressible sealing element from an area exterior of the compressible sealing element. The shroud junction is entirely within an area interior of the compressible sealing element.

13 Claims, 4 Drawing Sheets

2
26
4
3
10
8
5
6
9
22
1
7
11
11a
11

SEALED LAND GRID ARRAY CONNECTOR

FIELD OF THE INVENTION

The present invention relates to the field of electrical connectors and more specifically to the area of sealed electrical connectors.

BACKGROUND OF THE INVENTION

A hard disk assembly(HDA) houses a magnetic information storage medium typically referred to in the industry as a disk. Read/write disk heads, also housed within an HDA, retrieve and store data by detecting the polarity of ferrite elements on the disk surface. During normal disk operation, read/write disk heads "float" over the surface of the disk as it spins. The "float" is a small gap between the read/write disk heads and the disk surface. Particulates and gases that enter the gap causes errors in information storage and retrieval and in some cases irreparable physical damage to the disk.

The typical HDA comprises a subassembly of a commercial disk drive fully enclosed in a hermetically sealed aluminum HDA frame. The HDA is assembled, evacuated, and sealed in a clean room environment. The HDA subassembly is further incorporated into a commercial product in a standard manufacturing environment. The HDA seal resists seepage of atmospheric particulates and gases into the "float". The presence of the particulates and gases can cause intermittent errors which renders a disk drive unreliable. In some cases the disk will become nonfunctional and disk users may suffer irretrievable loss of data stored thereon.

The HDA further requires sealed electrical access to printed circuit boards physically located on the exterior of the HDA frame. A known sealed electrical access utilizes a pin header and two receptacles plugged into opposite sides thereof. A first receptacle connects to typically a flexible film via solder on an interior of the HDA frame and plugs into one side of the pin header. The pin header mounts into an opening in the HDA frame. A second receptacle plugs into the opposite side of the pin header for electrical access to the exterior of the HDA frame. An operator forces a curable polymer into a junction between a periphery of the pin header and the HDA frame. The polymer, when cured, provides a seal sufficient to isolate the interior of the HDA from undesirable particulates and gases.

U.S. Pat. No. 4,976,634 discloses a sealing system in which solid sealant preforms occupy a peripheral channel in a connector body. The occupied channel in the body meets a corresponding recess in a protective shroud. Both body and shroud are held together and heated. The heating causes the preforms to reflow and form a bond and a seal between the body and the shroud.

An HDA seal comprised of a curable polymer seal is known for outgasing during curing of the polymer, which causes gases to enter into the interior of the HDA. These gases can interfere with the read/write disk operations in the same way as particulates and gases that seep from the atmosphere. Accordingly, there has been a need for a connector capable of being manufactured according to standard low cost manufacturing processes, that will provide a reliable hermetic seal in an HDA frame without requiring the use of a curable polymer. Advantages to dispensing with a curable polymer include the opportunity to dispense with clean room handling of potting material and equipment, provide better control over the manufacturing process with regard to seals, and reduce time to manufacture.

Consistent with current trends in the electronic industry toward increased complexity and miniaturization, it is generally desirable for a connector to provide a large number of surface contacts within a small area. Accordingly, there is a need for a connector that provides a number of surface electrical contacts in a minimum amount of space.

SUMMARY

The present invention provides an electrical connector that may be manufactured using known low cost, automated processes for sealably mounting into an opening in a frame. At least one contact element extends through an insulating connector body. A body thickness sealingly encircles each contact element. The body has a frame abutting surface. A continuous compressible sealing element is disposed on the frame abutting surface and delineates an area interior of the compressible sealing element from an area exterior of the compressible sealing element. A separate shroud interfits with the body according to standard manufacturing tolerances creating a shroud junction interposed between the body and the shroud. The shroud junction is circumscribed by the compressible sealing element which obviates the need for a separate and costly sealing at the shroud junction.

Other advantages and results of the invention are apparent from a following detailed description by way of example of the invention and from the accompanying drawings.

DETAILED DESCRIPTION OF THE INVENTION

Figure 1:
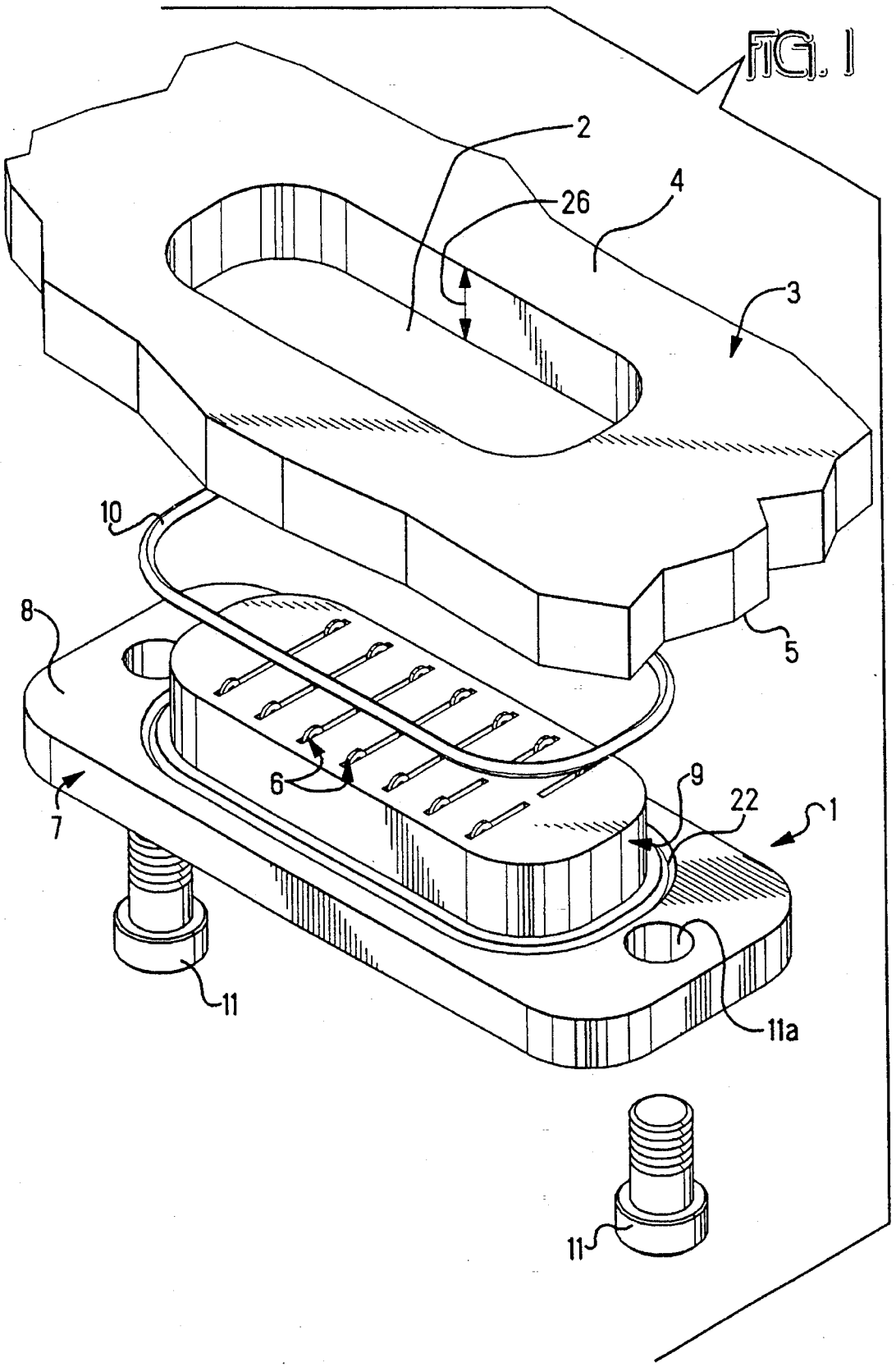
FIG. 1 is an exploded perspective top view of an embodiment of the present invention showing a connector, a compressible sealing element, screws, and an opening in a receiving frame.
Figure 3:
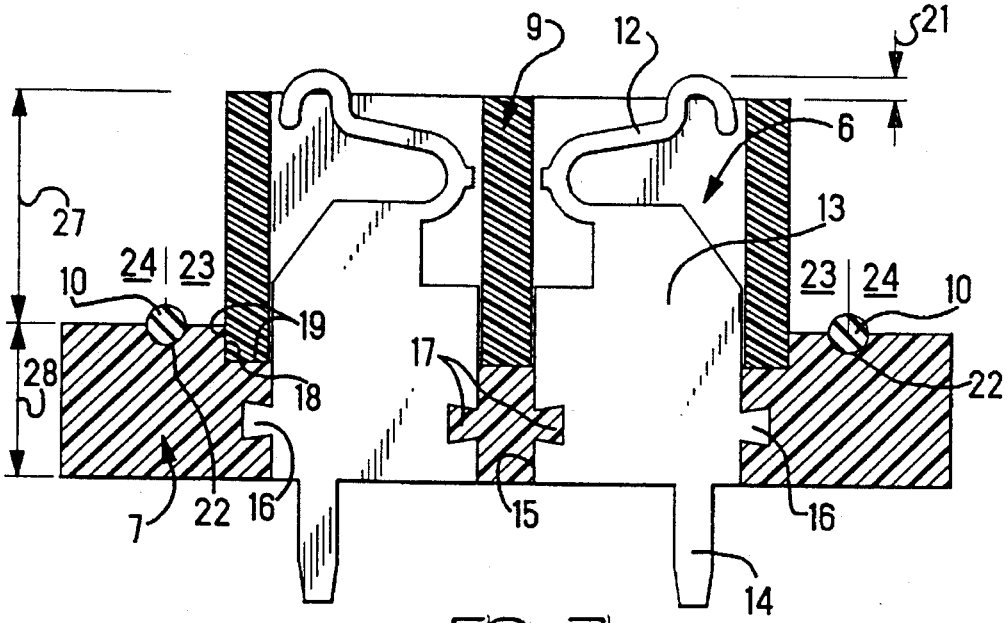
FIG. 3 is a cross sectional view taken along axis 3—3 of FIG. 2.

With more particular reference to the drawings, FIG. 1 shows a connector 1 that mounts into an opening 2 in a frame 3 that will hermetically seal one side 4 of the frame from a second side 5. The connector 1 comprises at least one contact element 6, an overmolded body 7 having a frame abutting surface 8, a shroud 9, and an compressible sealing element 10 disposed on said frame abutting surface 8. The frame 3 receives the shroud 9 in a connector opening 2. Screws 11 extend through screw holes **11*a* in the connector 1 to attach the connector 1 to the frame 3 and to compress the compressible sealing element 10. With reference to FIG. 3, compression of the compressible sealing element 10 results in a seal sufficient to withstand a pressure differential of 14 pounds per square inch that isolates an area interior 23 of the compressible sealing element 10 from an area exterior 24 of the compressible sealing element 10. Alternative methods to achieve compression of the compressible sealing element 10 between the body 7 and the frame 3** may be used.

Figure 2:
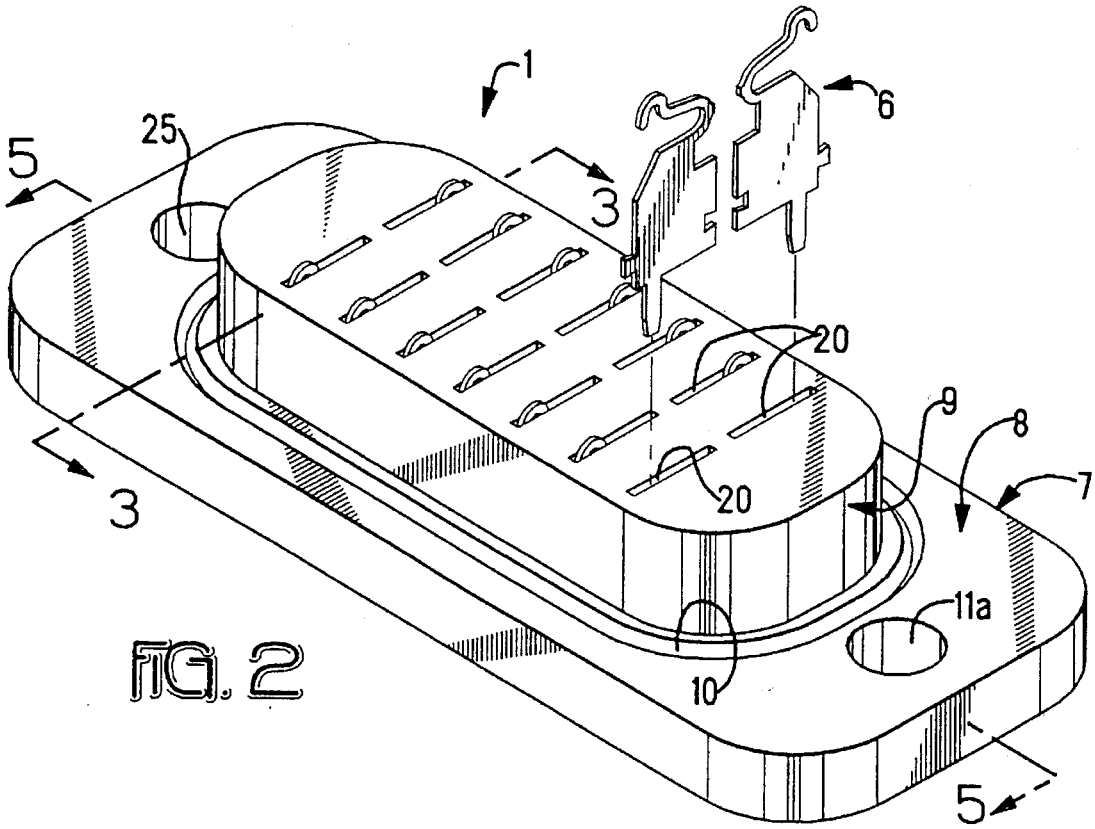
FIG. 2 is an exploded perspective view showing a shroud substantially encircling contact elements.

With reference to FIGS. 2 and 3, contact elements 6 are stamped out of a sheet of electrically conductive material. The material for the contact elements has a modulus of elasticity and a yield strength similar to that of phosphor-bronze. The elements are plated with tin-lead to provide a reliable electrical contact over time. Each contact element 6 has a compliant head 12, a medial section 13, and a tail 14. The contact elements 6 are positioned in a desired grid pattern, for example a two by seven grid shown in FIG. 2, with the medial sections 13 vertically aligned and perpendicular to a common plane. The medial sections 13 of the contact elements 6 are overmolded with an insulating material to form the connector body 7. Material used for form the connector body has a sufficiently high melting point to withstand solder temperatures and is sufficiently rigid to provide structural support for the contact elements. The overmolding process hermetically seals a contact junction 15 between the medial section 13 of each contact element 6 and the body 7. A tab 16 and a notch 17 on the medial section 13 of each contact element 6 create pockets of engagement between the contact element 6 and the body 7. The pockets of engagement resist movement of the contact elements 6 relative to the body 7 and maintain the contact elements 6 in proper alignment. The tab 16 faces a direction toward an outside of the body 7 and the notch 17 faces a direction toward a center of the body 7.

The body 7 has a recess 18 adjacent to and circumnavigating a periphery of all of the contact elements 6. The shroud 9 interfits with the body 7 in the recess 18 defining a shroud junction 19 interposed between the shroud 9 and the body 7. The shroud junction 19 need not be sealed for proper operation of the invention. The body 7 interlocks with the shroud 9 retaining it in an interference fit. The shroud 9 comprises multiple chambers 20. Each chamber 20 receives a single compliant head 12. The chambers 20 serve to isolate each head 12 from neighboring contact elements 6 and from the frame 3. Each chamber 20 substantially encircles each compliant head 12. The compliant head 12 extends past the chamber 20 a deflection distance 21 equivalent to a vertical deflection distance of the compliant head 12.

The body 7 has a frame abutting surface 8. The frame abutting surface 8 has a continuous arcuate channel 22 and therearound. The channel 22 is positioned on an outer periphery of the shroud junction 19. The compressible sealing element 10 occupies the channel 22. Screw holes 11*a* at opposite ends of the connector body 7 are on an outside of the peripheral channel 22. The channel 22 and compressible sealing element 10 delineate an area interior 23 of the compressible sealing element 10 which is to be sealed from an area exterior 24 of the compressible sealing element 10. The shroud junction 19 is completely enclosed within an area interior 23 of the compressible sealing element 10.

Figure 4:
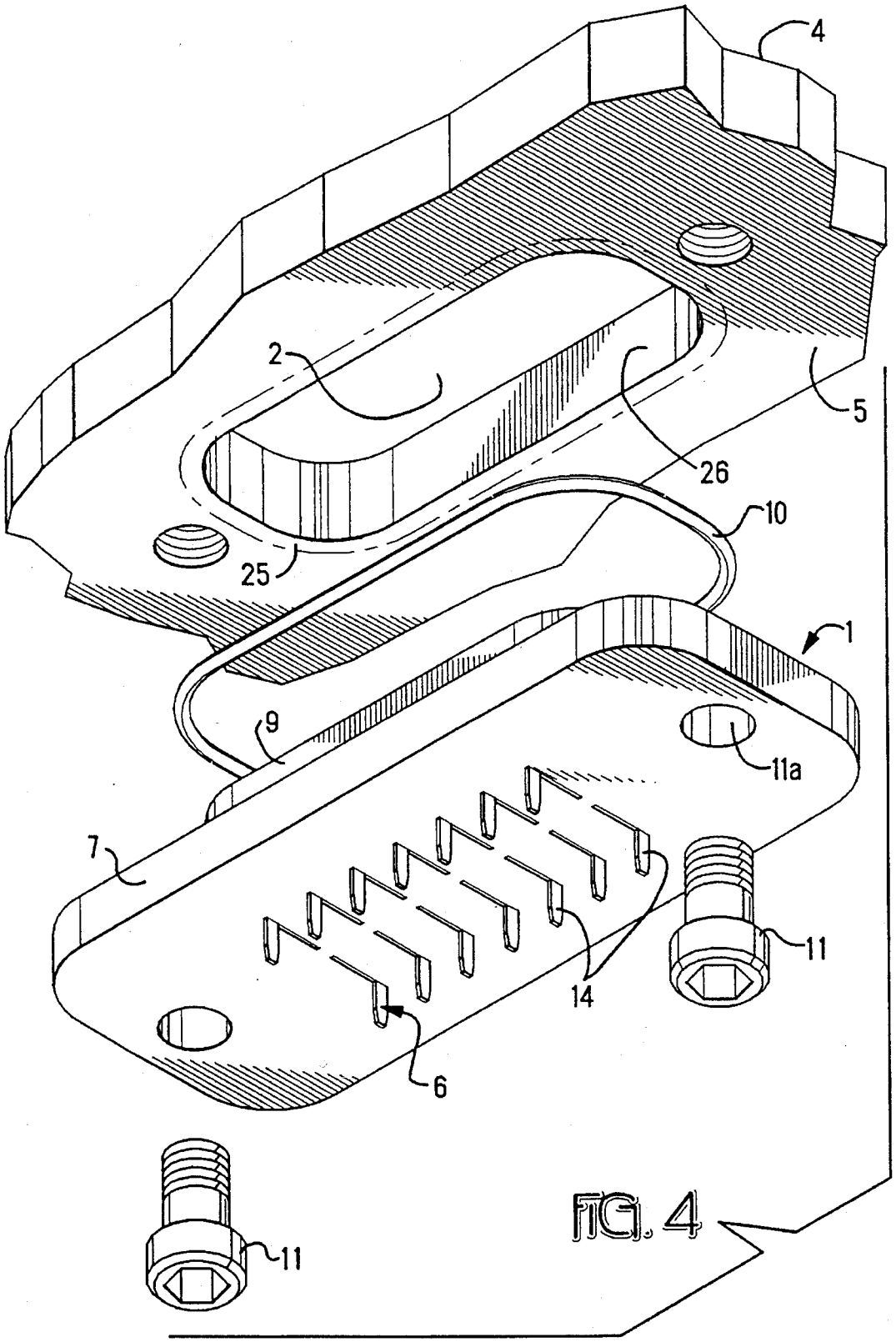
FIG. 4 is an exploded perspective bottom view of the embodiment illustrated in FIG. 1.
Figure 5:
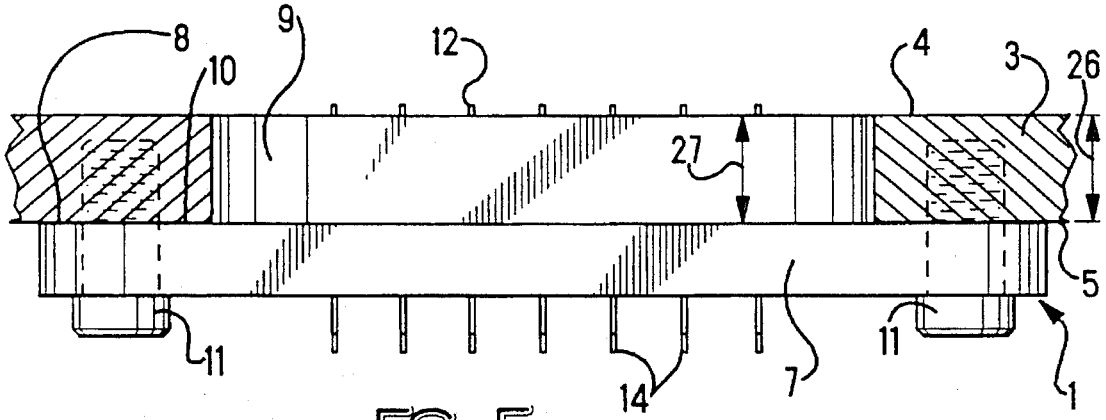
FIG. 5 is a cross sectional view taken along axis 5—5 of FIG. 2.
Figure 6:
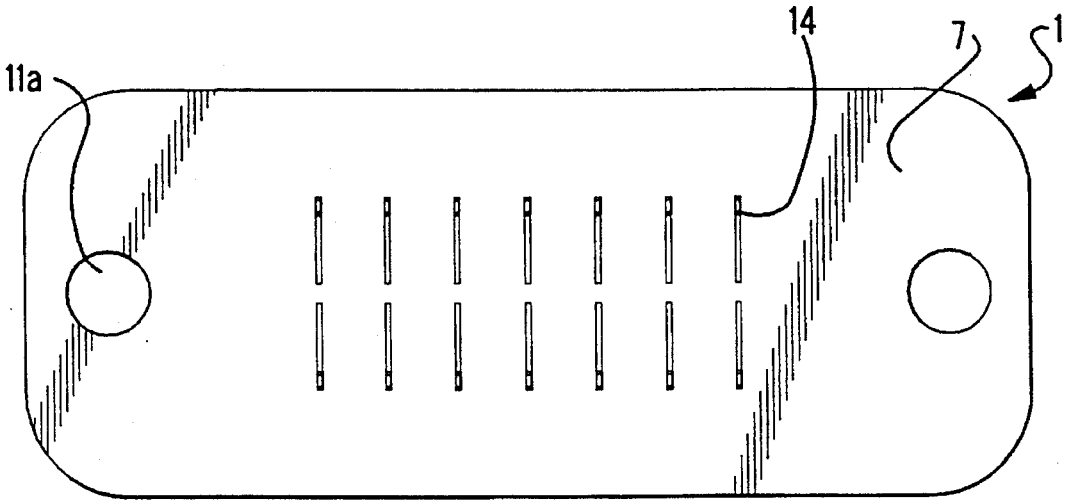
FIG. 6 is a bottom plan view of the embodiment illustrated in FIG. 1.

With reference to FIGS. 1 and 4, the frame 3 receives the connector 1 into the opening 2. The frame abutting surface 8 abuts a frame surface 25 on a periphery of the opening 2. The shape of the opening 2 is substantially similar to that of the shroud 9. The size of the opening 2 is sufficiently large for insertion of the shroud 9 and sufficiently small such that the frame surface 25 intercepts the frame abutting surface 8 on the body 7. With reference to FIGS. 3 and 4, a frame thickness 26 is spanned by a shroud height 27 that extends perpendicular to the frame abutting surface 8. An operator installs the connector 1 by placing the shroud 9 of the connector 1 into the opening 2 on the frame 3 with the frame abutting surface 8 of the connector 1 against the frame surface 25. The screws 11 extend through the screw holes 11*a* in the body 7 and screw holes in the frame 3. The screws 11 compress the compressible sealing element 10 between the panel abutting surface 8 and the frame surface 25. When the connector 1 is in compressible engagement with the frame 3, the frame surface 25 completely covers the channel 22 and compressible sealing element 10. A seal resulting from the compressible engagement of the connector 1 and frame 3 isolates an area interior 23 of the compressible sealing element 10 from an area exterior 24 of the compressible sealing element 10.

With reference to FIG. 3, manufacturing tolerances between the contact elements 6 and contact element receiving cavities in the body 7 are eliminated when the body is formed by injection molding. Advantageously, the process of injection molding eliminates such tolerances, and forms a seal between a body thickness 28 and each of the contact elements 6 encircled by the body 7. Such a seal resists seepage of atmospheric borne particulates and gasses.

The body 7 is manufactured as a plate of uniform thickness interrupted solely by a recess 18 for interfitting the body 7 with the shroud 9. A depth of the recess 18 on the body 7 is sufficiently deep to receive and retain the shroud 9 in an interference fit, and sufficiently shallow to have no adverse impact on the quality of the seal along the contact junctions 15 created by the body thickness 28. This simplicity of shape reduces the complexity and cost of the mold tooling that is used for manufacturing the body 7. The shroud 9 manufactured as a separate part, interfits with the body 7 according to standard manufacturing tolerances. Interfitting the body 7 with the shroud 9 at the recess 18 creates the shroud junction 19 interposed between the body 7 and the shroud 9. A costly seal at the shroud junction 19 is unnecessary, even though seepage of atmospheric borne particulates and gasses is likely to occur at the intersection of the separate parts. The shroud junction 19 is solely on one side of the body 7, and the body thickness 28 underlies such one side, whereby the seal formed by the body thickness 28 and each of the contact elements 6 is impervious to such seepage.

Seepage at an intersection of the frame abutting surface 8 of the connector 1 and the frame 3 is resisted by the construction of the frame abutting surface 8 and its location. For example, the frame abutting surface 8 is continuous and uninterrupted, and circumscribes the intersection of the shroud 9 and the body 7 that are assembled together with standard manufacturing tolerances. When the shroud 9 is mounted in the frame 3 to face airborne particulates and gasses, seepage of these contaminants around the shroud junction 19 can occur without adverse impact because the particulates and gasses do not seep into the area exterior 24 sealed by the compressible sealing element 10. When the shroud 9 is mounted in the frame 3 in an opposite facing direction, the frame abutting surface 8 against the frame 3 resists seepage of airborne particulates and gasses from entering the circumscribed intersection of the shroud 9 and the body 7.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

I claim:

1. An electrical connector for mounting in a frame comprising:

a. at least one contact element having a compliant head portion, which is axially displaceable along a longitudinal mating axis, b. an overmolded body retaining said contact elements wherein said body has a frame abutting surface, c. a compressible sealing element disposed on said frame abutting surface, circumscribing an area interior of said compressible sealing element, d. a shroud mated to said body creating a shroud junction between said shroud and said body wherein, said shroud junction is contained entirely within said area interior of said compressible sealing element, and e. at least one retention element that cooperates with said body to compress said compressible sealing element between said body and the frame.

2. An electrical connector as recited in claim 1 wherein, said frame abutting surface has a channel therein and said compressible sealing element occupies said channel.

3. An electrical connector as recited in claim 1, wherein said shroud has multiple chambers and each said chamber separately and substantially encircles each respective compliant head.

4. An electrical connector as recited in claim 1 wherein, each said contact element has a medial section over which said body is molded.

5. An electrical connector as recited in claim 4 wherein, said medial section comprises:

a. a tab that faces a direction toward the outer edge of said body, and b. a notch that faces a direction toward the center of said body.

6. A sealed electrical connector for mounting in a frame comprising:

a. an insulating body having a frame abutting surface, b. a shroud interfitting with said body to create an unsealed shroud junction interposed between said body and said shroud, c. at least one contact element extending through said body and into an interior of said shroud, d. portions of said body sealingly encircle each of said contact elements and underlie said shroud junction, and e. a continuous compressible sealing element disposed on said frame abutting surface delineating an area interior and an area exterior wherein, said shroud junction is enclosed entirely within said area interior and sealingly isolates said shroud junction and said area interior from said area exterior when said frame abutting surface is in compressible engagement with the frame.

7. A sealed electrical connector as recited in claim 6 wherein, said body is molded over said contact elements.

8. A sealed electrical connector as recited in claim 6 wherein, said body has a recess for receiving and retaining said shroud in an interference fit.

9. A sealed electrical connector as recited in claim 6 wherein, said body is generally planar.

10. A sealed electrical connector as recited in claim 9 wherein, said body is generally of a uniform thickness.

11. An electrical connector for mounting in a frame comprising:

a. at least one contact element, b. an overmolded body retaining said contact elements wherein said body has a frame abutting surface, c. a compressible sealing element disposed on said frame abutting surface, circumscribing an area interior of said compressible sealing element, d. a shroud mated to said body creating a shroud junction between said shroud and said body, wherein, said shroud junction is contained entirely within said area interior of said compressible sealing element, e. at least one retention element that cooperates with said body to compress said compressible sealing element between said body and the frame, and f. each said contact element includes a medial section having a tab that faces a direction toward the outer edge of said body, and a notch that faces a direction toward the center of said body.

12. The electrical connector of claim 11, wherein said frame abutting surface comprises a groove for receiving said sealing element.

13. The electrical connector of claim 11, wherein said contact and said body are interlocked by said tab and said notch.

* * * * *